US006776730B2

(12) United States Patent
Moriyama et al.

(10) Patent No.: US 6,776,730 B2
(45) Date of Patent: Aug. 17, 2004

(54) GOLF BALL

(75) Inventors: Keiji Moriyama, Kobe (JP); Takahiro Sajima, Kobe (JP)

(73) Assignee: Sumitomo Rubber Industries Ltd., Kobe (JP)

( * ) Notice: Subject to any disclaimer, the term of this patent is extended or adjusted under 35 U.S.C. 154(b) by 0 days.

(21) Appl. No.: 10/305,148

(22) Filed: Nov. 27, 2002

(65) Prior Publication Data

US 2003/0109334 A1 Jun. 12, 2003

(30) Foreign Application Priority Data

Dec. 11, 2001 (JP) ..... 2001-376770

(51) Int. Cl.[7] ..... A63B 37/14
(52) U.S. Cl. ..... 473/383
(58) Field of Search ..... 473/378, 383, 473/384

(56) References Cited

U.S. PATENT DOCUMENTS 4,813,677 A 3/1989 Oka et al.
5,080,367 A 1/1992 Lynch et al.
5,292,132 A 3/1994 Oka
5,911,639 A * 6/1999 Kasashima et al. ..... 473/377
6,346,053 B1 * 2/2002 Inoue et al. ..... 473/378

* cited by examiner

*Primary Examiner*—Raeann Gorden
(74) *Attorney, Agent, or Firm*—Birch, Stewart, Kolasch & Birch, LLP

(57) ABSTRACT

A golf ball has a large number of dimples (A to D) on a surface thereof. A surface area occupation ratio Y of the dimples in the golf ball is 0.80 to 0.90. A mean curvature R to be a mean value of a curvature r in the sectional shape of the dimple is 16 mm or more. A total volume V of the dimples is 300 $mm^3$ to 700 $mm^3$. A mean occupation ratio y to be a value obtained by dividing the surface area occupation ratio Y by a total number N of the dimples is 0.0022 or more. A sum X of a contour length x of the dimple and the surface area occupation ratio Y satisfy a relationship indicated by an expression (I):

$$X \leqq 3882 \cdot Y + 1495 \quad \text{(I).}$$

6 Claims, 13 Drawing Sheets

GOLF BALL

BACKGROUND OF THE INVENTION

1. Field of the Invention

The present invention relates to a golf ball and more particularly to an improvement in a dimple of the golf ball.

2. Description of the Related Art

A golf ball has approximately 200 to 550 dimples on a surface thereof. The role of the dimples resides in one aspect that such dimples disturb an air stream around the golf ball during the flight to accelerate the transition of a turbulent flow at a boundary layer, thereby causing a turbulent flow separation (which will be hereinafter referred to as a "dimple effect"). The acceleration of the transition of the turbulent flow causes a separating point of air from the golf ball to be shifted backward so that a drag coefficient (Cd) is reduced, resulting in an increase in the flight distance of the golf ball. In addition, the acceleration of the transition of the turbulent flow increases a differentia between upper and lower separating points of the golf ball which is caused by a back spin. Consequently, a lift acting on the golf ball is increased.

Examples of the specifications to greatly influence the flight performance of a golf ball include a total volume of dimples. The trajectory of a golf ball having a total volume which is too small tends to hop, and the trajectory of a golf ball having a total volume which is too large tends to drop. In any case, a sufficient flight distance cannot be obtained. In order to obtain a proper trajectory and a great flight distance, the total volume of the dimples is to be set within a predetermined range.

Various proposals for the density of a dimple have also been made. For example, Japanese Patent Publication No. Sho 58-50744 (U.S. Pat. No. 5,080,367) has disclosed a golf ball in which dimples are densely provided such that a pitch between the dimples is set to 1.62 mm or less if possible. Japanese Laid-Open Patent Publication No. Sho 62-192181 (U.S. Pat. No. 4,813,677) has disclosed a golf ball in which dimples are densely provided so as not to form a new dimple having an area which is equal to or larger than a mean area in a land portion other than the dimples. Japanese Laid-Open Patent Publication No. Hei 4-347177 (U.S. Pat. No. 5,292,132) has disclosed a golf ball in which dimples are provided very densely such that the number of land portions in which a rectangle having a predetermined dimension can be drawn is 40 or less. All the golf balls disclosed in the known publications have dimples provided densely, in other words, the surface area occupation ratio of the dimple is increased. The skilled in the art have recognized that the surface area occupation ratio is one of the important specifications to influence a dimple effect.

A golf player is very interested in making a good score and causing a golf ball to fly to a distance. A large number of golf players desire a golf ball which is excellent in a flight performance. As described above, various improvements have been made in relation to the total volume and surface area occupation ratio of the dimples. However, a golf ball to meet the demand of the golf player has not been obtained.

SUMMARY OF THE INVENTION

The present inventors have taken note of a mean curvature R as an important element to influence the dimple effect. The present inventors have found that an existing golf ball having a greater mean curvature R tends to be more excellent in a flight performance if a surface area occupation ratio Y is equal. By setting the relationship between the surface area occupation ratio Y and the mean curvature R to a range which cannot be obtained by the existing golf ball, the flight performance could be enhanced.

A golf ball according to the present invention has a large number of dimples on a surface thereof. A surface area occupation ratio Y of the dimples is 0.80 to 0.90. A mean curvature R of the dimples is 16 mm or more. The mean curvature R implies a mean value of a curvature r in the sectional shape of the dimple.

In a golf ball in which the surface area occupation ratio Y satisfies the range and the mean curvature R satisfies the range, the ratio of the occupation of dimples having comparatively large areas is high. The reason why the flight performance of the golf ball is excellent is not clear in detail. It is guessed that a dimple having a great curvature r contributes to a reduction in a drag coefficient (Cd), particularly, a reduction in the drag coefficient (Cd) in a high-speed region immediately after hitting.

It is preferable that a total volume V of the dimples should be 300 $mm^3$ to 700 $mm^3$. Such a golf ball presents a more excellent flight performance.

It is preferable that a mean occupation ratio y to be a value obtained by dividing the surface area occupation ratio Y by a total number N of the dimples should be 0.0022 or more. In such a golf ball, the ratio of the occupation of dimples having comparatively large areas is high. The golf ball presents a more excellent flight performance.

It is preferable that a sum X of a contour length x of the dimple and the surface area occupation ratio Y should satisfy a relationship indicated by an expression (I):

$$X \leqq 3882 \cdot Y + 1495 \quad \text{(I).}$$

Such a golf ball includes a dimple pattern having a smaller total contour length X for the surface area occupation ratio Y. The golf ball presents a more excellent flight performance.

It is preferable that a ratio of the number of dimples having a contour length x of 10.5 mm or more to a total number N of the dimples should be 91% or more. Such a golf ball presents a particularly excellent flight performance.

DESCRIPTION OF THE PREFERRED EMBODIMENTS

The present invention will be described below in detail based on a preferred embodiment with reference to the drawings.

Figure 1:
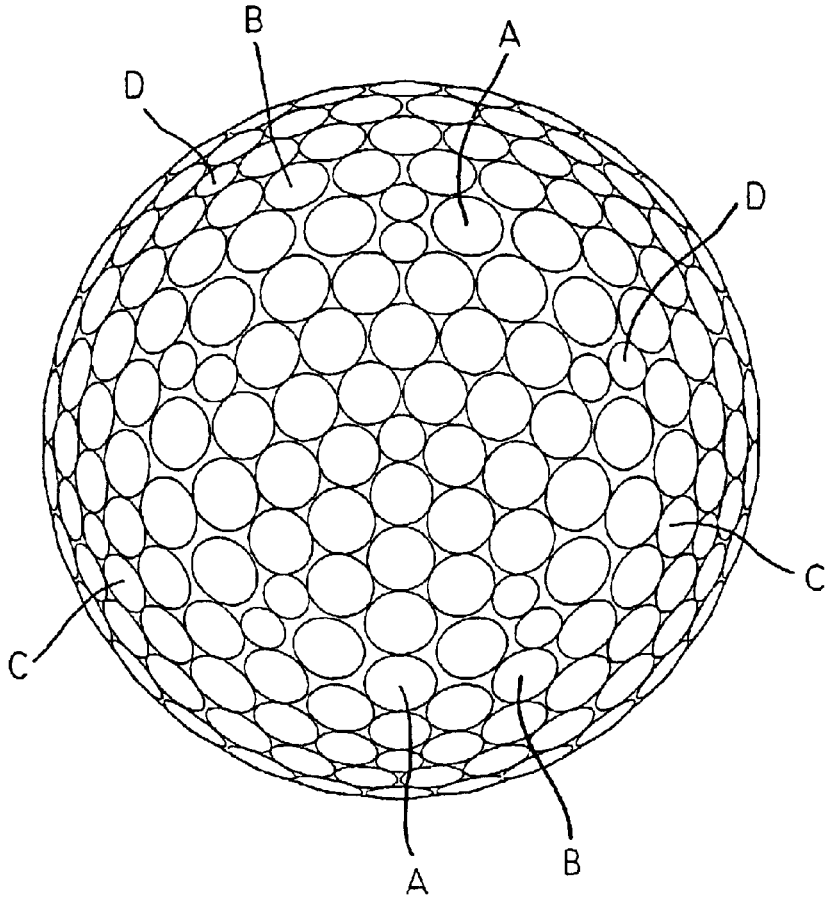
FIG. 1 is a plan view showing a golf ball according to an embodiment of the present invention.
Figure 2:
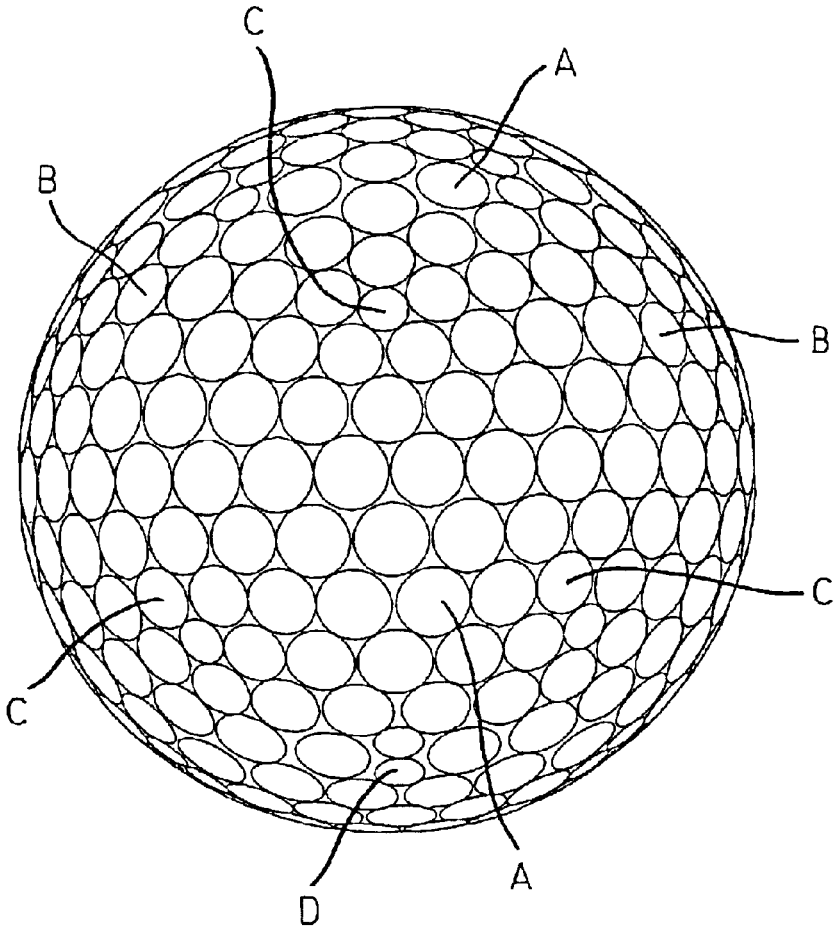
FIG. 2 is a front view showing the golf ball in FIG. 1.

A golf ball shown in FIGS. 1 and 2 has a diameter of 40 mm to 45 mm, and furthermore, 42 mm to 44 mm. From the viewpoint of the fact that an air resistance is reduced within such a range as to satisfy the standards of the United States Golf Association (USGA), it is preferable that the diameter should be set to 42.67 mm to 42.80 mm. The golf ball has a mass of 40 g to 50 g, and furthermore, 44 g to 47 g. From the viewpoint of the fact that an inertia is increased within such a range as to satisfy the standards of the United States Golf Association, it is preferable that the mass should be set to 45.00 g to 45.93 g.

The golf ball includes an A dimple having a circular plane shape and a diameter of 4.5 mm, a B dimple having a circular plane shape and a diameter of 4.1 mm, a C dimple having a circular plane shape and a diameter of 3.5 mm, and a D dimple having a circular plane shape and a diameter of 2.7 mm. In this specification, the term of "plane shape" implies a shape of a contour line to be a boundary between a virtual spherical surface and a dimple as seen at infinity. The number of the A dimples is 130, that of the B dimples is 150, that of the C dimples is 60 and that of the D dimples is 32. The total number of the dimples of the golf ball is 372.

Figure 3:
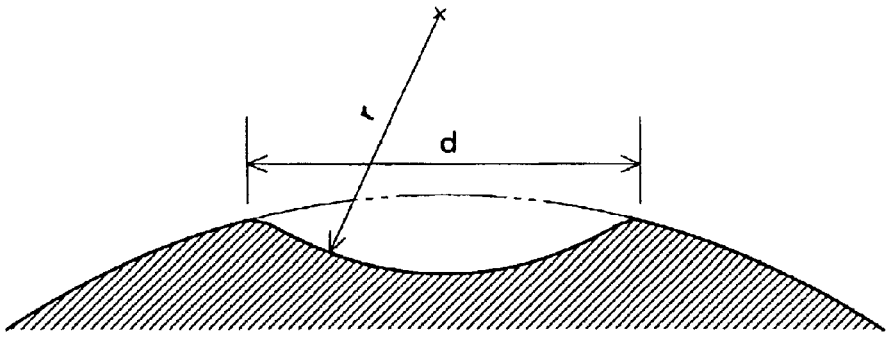
FIG. 3 is a typical enlarged sectional view showing a part of the golf ball in FIG. 1.

FIG. 3 is a typical enlarged sectional view showing a part of the golf ball in FIG. 1. FIG. 3 shows a planar section taken along a center of gravity of the plane shape of the dimple and a center of the golf ball. As is apparent from FIG. 3, the dimple takes the sectional shape of a circular arc. In other words, the surface of the dimple constitutes a part of a spherical surface. In FIG. 3, a curvature of a circular arc constituting the sectional shape is shown in an arrow r. In the case of a dimple taking a sectional shape which is not the circular arc and a dimple having a non-circular plane shape, the curvature r is varied depending on a measuring portion. In such a case, it is possible to suppose a circular dimple taking a circular arc-shaped section which has the same area as that of the plane shape of the dimple and the same volume as that of the dimple. Based on the sectional shape of the dimple thus supposed, the curvature r is calculated.

In this specification, the term of "mean curvature" implies a mean value of the curvatures of all the dimples. For example, in the case of a golf ball including n1 dimples having a curvature r1, n2 dimples having a curvature r2 and n3 dimples having a curvature r3, a mean curvature R is calculated by the following equation.

$$R=(r1\cdot n1+r2\cdot n2+r3\cdot n3)/(n1+n2+n3)$$

In the golf ball shown in FIGS. 1 and 2, the A dimple has a curvature r of 23.98 mm, the B dimple has a curvature r of 19.91 mm, the C dimple has a curvature r of 14.53 mm, and the D dimple has a curvature r of 8.67 mm. Accordingly, the mean curvature R of the golf ball is 19.5 mm.

In FIG. 3, a diameter of the dimple is shown in an arrow d. The diameter d represents a distance between both contacts in the case in which a common tangent line is drawn on both ends of the dimple. The contact continues to form a contour line.

In this specification, the term of "surface area occupation ratio" implies a value obtained by dividing the sum of the areas of all the dimples by the surface area of a virtual sphere (which is obtained on the assumption that the dimple is not present and is shown in a two-dotted chain line of FIG. 3). The "area of the dimple" implies the area of the plane shape of the dimple. In the case of a circular dimple, an area s is calculated by the following equation.

$$s=(d/2)^2\cdot\pi$$

In the golf ball shown in FIGS. 1 and 2, the A dimple has an area s of 15.9 $mm^2$, the B dimple has an area s of 13.2 $mm^2$, the C dimple has an area s of 9.6 $mm^2$, and the D dimple has an area s of 5.7 $mm^2$. Accordingly, a sum S of the dimple areas is 4805.4 $mm^2$. The total area S is divided by the surface area of the virtual sphere so that a surface area occupation ratio Y is calculated. In the golf ball, the surface area occupation ratio Y is 0.840. By dividing the surface area occupation ratio Y by the total number N of the dimples, a mean occupation ratio y is calculated. In the golf ball, the mean occupation ratio y is 0.00226. The mean occupation ratio y implies an area ratio at which dimples having a mean area occupy the spherical surface of the virtual sphere.

In this specification, the "total volume" implies the sum of the volumes of all the dimples. The "volume of the dimple" implies the volume of a portion surrounded by the virtual sphere of the golf ball and the surface of the dimple. In the golf ball shown in FIGS. 1 and 2, a total volume V is 500.0 $mm^3$.

In this specification, the term of "total contour length" implies the sum of the contour lengths of all the dimples. The "contour length" implies a distance measured actually along the contour line of the dimple. For example, in the case in which the dimple has a triangular plane shape, the total length of three sides is represented by the contour length x. Since these sides are present on a spherical surface, they are not straight lines but circular arcs in a strict sense. The length of the circular arc is set to be the length of the side. In the case of a circular dimple, the contour length x is calculated by the following equation.

$$x=d\cdot\pi$$

In the golf ball shown in FIGS. 1 and 2, the A dimple has a contour length x of 14.1 mm, the B dimple has a contour length x of 12.9 mm, the C dimple has a contour length x of 11.0 mm and the D dimple has a contour length x of 8.5 mm. In the golf ball, a total contour length X is 4701.1 mm.

It is preferable that the surface area occupation ratio Y should be 0.80 to 0.90. If the surface area occupation ratio Y is less than the range, the lift of the golf ball might become insufficient during a flight. In this respect, the surface area occupation ratio Y is more preferably 0.81 or more and particularly preferably 0.83 or more. If the surface area occupation ratio Y exceeds the range, the trajectory of the golf ball might be too high. In this respect, it is particularly preferable that the surface area occupation ratio Y should be 0.87 or less.

The total volume V is preferably 300 $mm^3$ to 700 $mm^3$. If the total volume V is less than the range, a trajectory might hop. In this respect, it is more preferable that the total volume V should be 400 $mm^3$ or more, and it is particularly preferable that the total volume V should be 460 $mm^3$ or more. If the total volume V exceeds the range, the trajectory might drop. In this respect, it is more preferable that the total volume V should be 600 $mm^3$ or less, and it is particularly preferable that the total volume V should be 540 $mm^3$ or less.

In the case in which a designer is to design a golf ball having a predetermined total volume V and a high surface area occupation ratio Y, he (she) can use means for increasing the number of the dimples to achieve the surface area occupation ratio Y or means for increasing the mean curvature R to achieve the surface area occupation ratio Y. A golf ball capable of having a predetermined surface area occupation ratio Y achieved by a great mean curvature R presents an excellent flight performance. It is guessed that a dimple having a great curvature r, that is, a shallower dimple for a large area contributes to a reduction in a drag coefficient (Cd).

In respect of the flight performance, the mean curvature R is preferably 16 mm or more, more preferably 18 mm or more, and particularly preferably 20 mm or more. If the mean curvature R is too great, it is hard to design a dimple pattern. For this reason, the mean curvature R is preferably 30 mm or less, and particularly preferably, 25 mm or less.

While the curvature r of each dimple is not particularly restricted, it is usually set to 5 mm to 50 mm. A ratio of the number of dimples having a curvature r of 16 mm or more to a total number N is preferably 60% or more, more preferably 70% or more, and particularly preferably 80% or more. The ratio is ideally 100%.

It is preferable that the mean occupation ratio y should be 0.0022 or more. If the mean occupation ratio y is less than the range, the drag coefficient (Cd) might be increased in a region in which a flight speed is high, resulting in an insufficient flight distance of the golf ball. In this respect, the mean occupation ratio y is more preferably 0.00225 or more, further preferably 0.00230 or more, and particularly preferably 0.00250 or more. The golf ball having an extremely high mean occupation ratio y cannot maintain the original feature that the golf ball is an almost sphere. Therefore, the golf ball has a mean occupation ratio y of 0.00300 or less.

It is preferable that the surface area occupation ratio Y and the total contour length X should satisfy the relationship in the following expression (I).

$$X \leqq 3882 \cdot Y + 1495 \quad \text{(I)}$$

The golf ball has a smaller total contour length X for the surface area occupation ratio Y. The golf ball has a small drag coefficient (Cd) during a flight and presents an excellent flight performance. As long as the present inventors know, there has not been a golf ball satisfying the expression (I).

In respect of a reduction in the drag coefficient (Cd), it is more preferable that the total contour length X and the surface area occupation ratio Y should satisfy the following expression (II), further preferably the following expression (III), and particularly preferably the following expression (IV).

$$X \leqq 3882 \cdot Y + 1445 \quad \text{(II)}$$

$$X \leqq 3882 \cdot Y + 1335 \quad \text{(III)}$$

$$X \leqq 3882 \cdot Y + 1085 \quad \text{(IV)}$$

In order to maintain the original feature that the golf ball is an almost sphere, the total contour length X and the surface area occupation ratio Y are to satisfy the relationship in the following expression (V).

$$X \geqq 3882 \cdot Y + 95 \quad \text{(V)}$$

The total contour length X is properly determined based on the relationship with the surface area occupation ratio Y within the range to satisfy the expression (I), and is usually set to 2800 mm to 5000 mm, and particularly, 3100 mm to 4700 mm.

In respect of a reduction in the drag coefficient (Cd), the number of the dimples having a contour length x of 10.5 mm or more is preferably 91% of the total number of the dimples or more, and particularly preferably 95% or more. The ratio is ideally 100%.

While the size of each dimple is not particularly restricted, the circular dimple usually has a diameter d of 2.0 mm to 8.0 mm, and particularly 3.0 mm to 7.0 mm. It is possible to form a dimple of a simple kind or plural kinds. A non-circular dimple (a dimple having a non-circular plane shape) may be formed in place of the circular dimple or together with the circular dimple. In the case in which the non-circular dimple is to be formed, a contour length x is usually set to 6 mm to 25 mm, and particularly 9 mm to 22 mm. In respect of the easiness of manufacture of a mold for a golf ball, the non-circular dimple is not formed but only the circular dimple is preferably formed. In particular, a circular dimple having a circular arc-shaped section is preferable.

The total number of the dimples is preferably 200 to 500. If the total number is less than the range, there is a possibility that the original feature of the golf ball to be an almost sphere cannot be maintained. In this respect, it is particularly preferable that the total number should be 250 or more. If the total number exceeds the range, there is a possibility that the drag coefficient (Cd) might be increased, resulting in an insufficient flight distance. In this respect, it is particularly preferable that the total number should be 400 or less.

The diameter d, the curvature r, the volume and the like are obtained by actually measuring the golf ball. In general, the golf ball has a coated layer provided on a surface thereof and dimensions are precisely measured with difficulty by the influence of the coated layer in some cases. In the present invention, for convenience, it is also possible to actually measure a golf ball which has not been coated or to actually measure the dimension of a mold.

The structure of the golf ball is not particularly restricted and a so-called wound golf ball or a solid golf ball (a one-piece golf ball, a two-pieces golf ball, a three-pieces golf ball or the like) may be used. Moreover, a material is not particularly restricted and a well-known material can be used.

EXAMPLES

Example 1

A core formed of a solid rubber was put in a mold and an ionomer resin composition was injected to form a cover around the core. The surface of the cover was coated so that a golf ball according to an example 1 which has a dimple pattern shown in a plan view of FIG. 1 and a front view of FIG. 2 was obtained. The golf ball has an outside diameter of 42.70±0.03 mm, a weight of approximately 45.4 g, and a compression of 93±2 (by an ATTI compression tester produced by Atti Engineering Co., Ltd.).

The golf ball includes 130 A dimples having a circular plane shape, a diameter of 4.5 mm and a curvature r of 23.98 mm, 150 B dimples having a circular plane shape, a diameter of 4.1 mm and a curvature r of 19.91 mm, 60 C dimples having a circular plane shape, a diameter of 3.5 mm and a curvature r of 14.53 mm, and 32 D dimples having a circular plane shape, a diameter of 2.7 mm and a curvature r of 8.67 mm. In the golf ball, a total contour length X is 4701.1 mm, a total volume V is 500.0 $mm^3$, a mean curvature R is 19.5 mm, and a surface area occupation ratio Y is 0.840.

Example 2

A golf ball according to an example 2 which has a dimple pattern shown in a plan view of FIG. 1 and a front view of FIG. 2 was obtained in the same manner as in the example 1 except that the mold was changed. The golf ball includes 130 A dimples having a circular plane shape, a diameter of 4.5 mm and a curvature r of 20.07 mm, 150 B dimples having a circular plane shape, a diameter of 4.1 mm and a curvature r of 16.67 mm, 60 C dimples having a circular plane shape, a diameter of 3.5 mm and a curvature r of 12.17 mm, and 32 D dimples having a circular plane shape, a diameter of 2.7 mm and a curvature r of 7.27 mm. In the golf ball, a total contour length X is 4701.1 mm, a total volume V is 550.0 $mm^3$, a mean curvature R is 16.3 mm, and a surface area occupation ratio Y is 0.840.

Example 3

Figure 4:
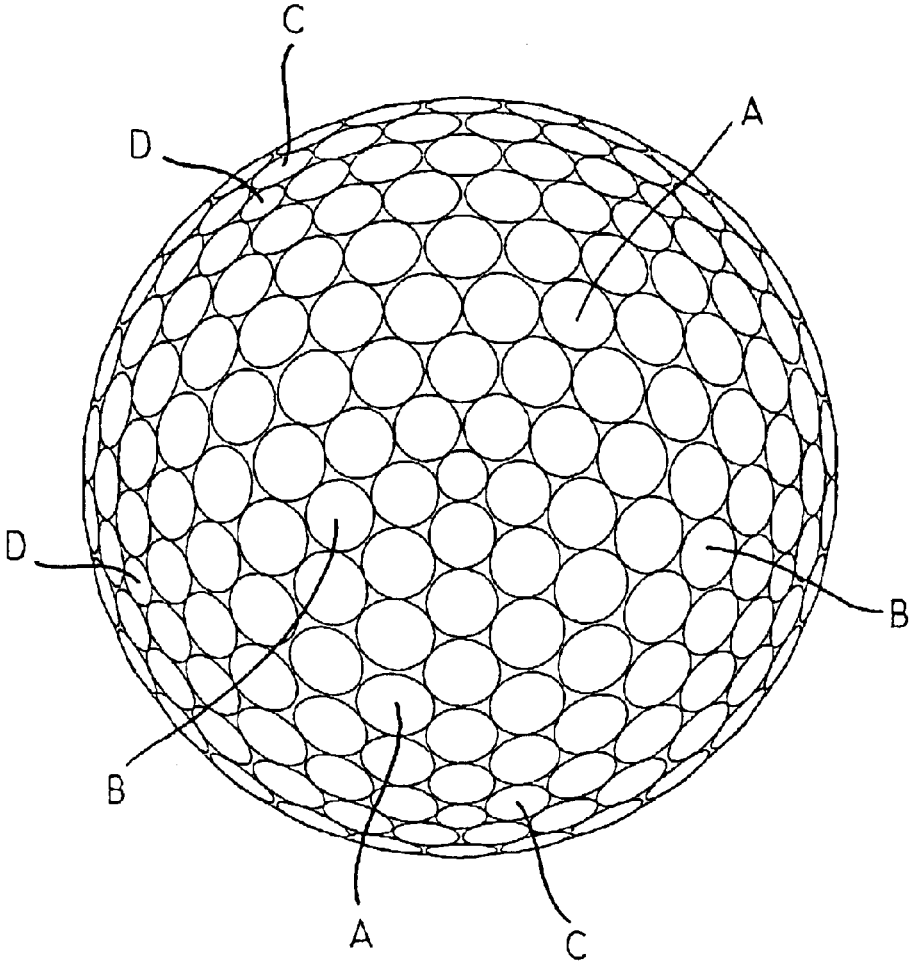
FIG. 4 is a plan view showing a golf ball according to an example 3 of the present invention.
Figure 5:
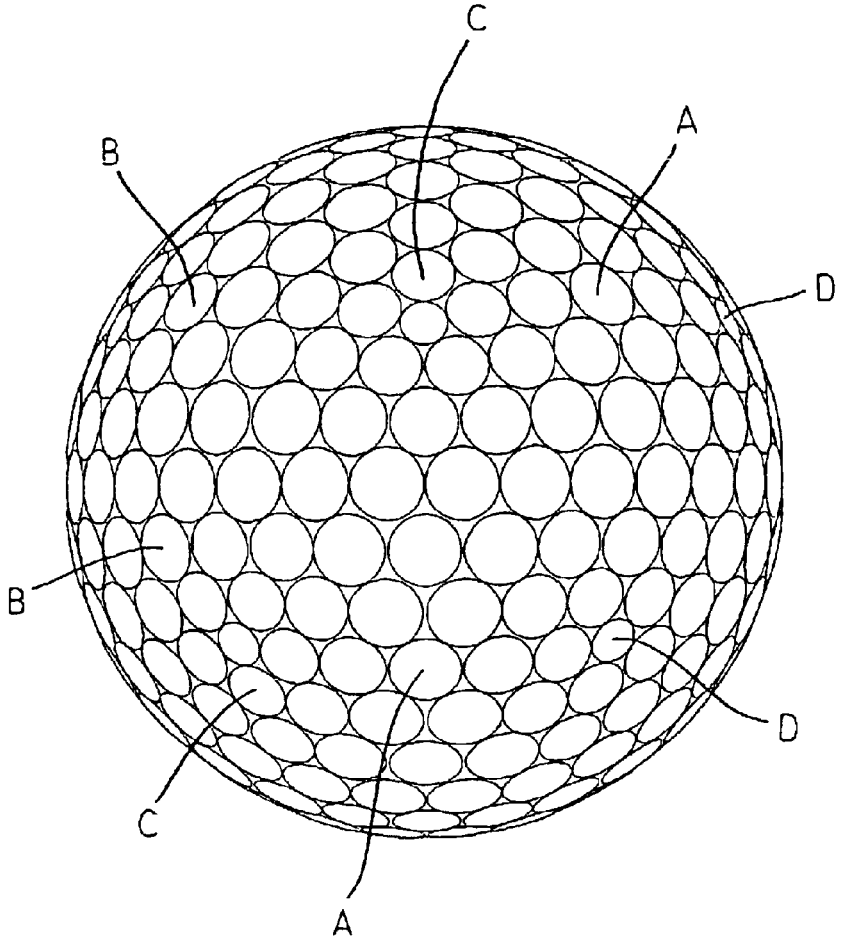
FIG. 5 is a front view showing the golf ball in FIG. 4.

A golf ball according to an example 3 which has a dimple pattern shown in a plan view of FIG. 4 and a front view of FIG. 5 was obtained in the same manner as in the example 1 except that the mold was changed. The golf ball includes 170 A dimples having a circular plane shape, a diameter of 4.4 mm and a curvature r of 21.64 mm, 120 B dimples having a circular plane shape, a diameter of 4.0 mm and a curvature r of 17.90 mm, 60 C dimples having a circular plane shape, a diameter of 3.4 mm and a curvature r of 12.95 mm, and 12 D dimples having a circular plane shape, a diameter of 2.3 mm and a curvature r of 5.95 mm. In the golf ball, a total contour length X is 4585.5 mm, a total volume V is 500.1 $mm^3$, a mean curvature R is 18.4 mm, and a surface area occupation ratio Y is 0.818.

Example 4

Figure 6:
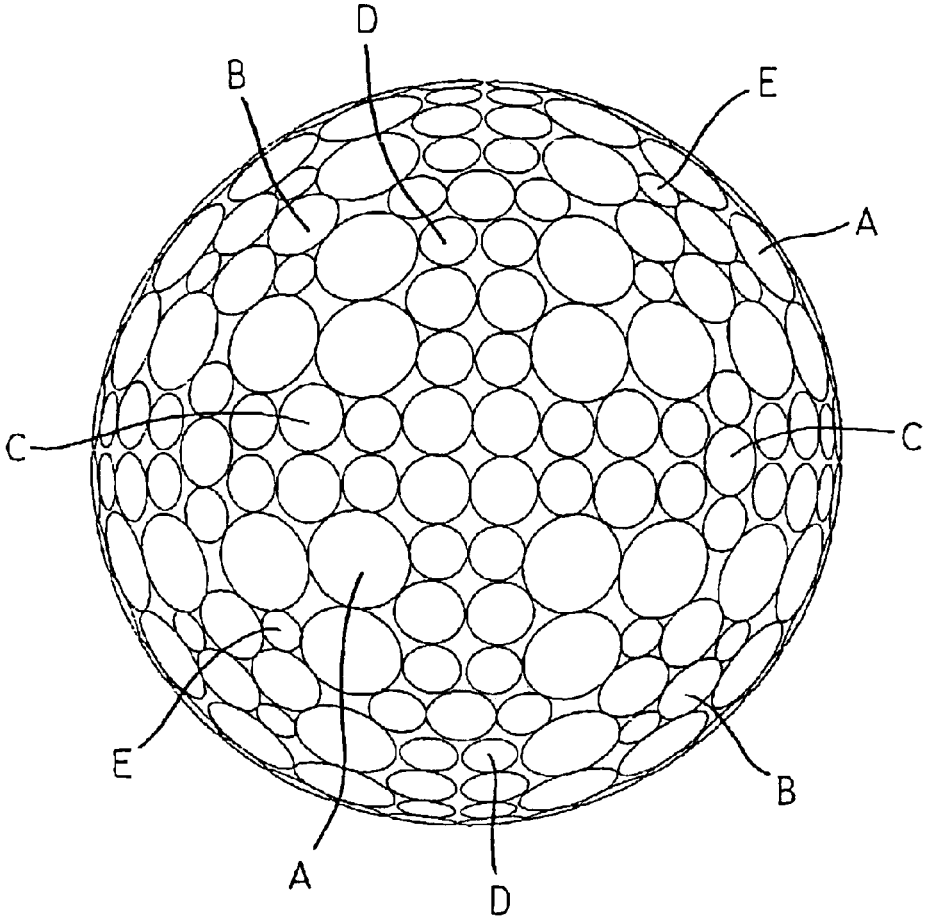
FIG. 6 is a plan view showing a golf ball according to an example 4 of the present invention.
Figure 7:
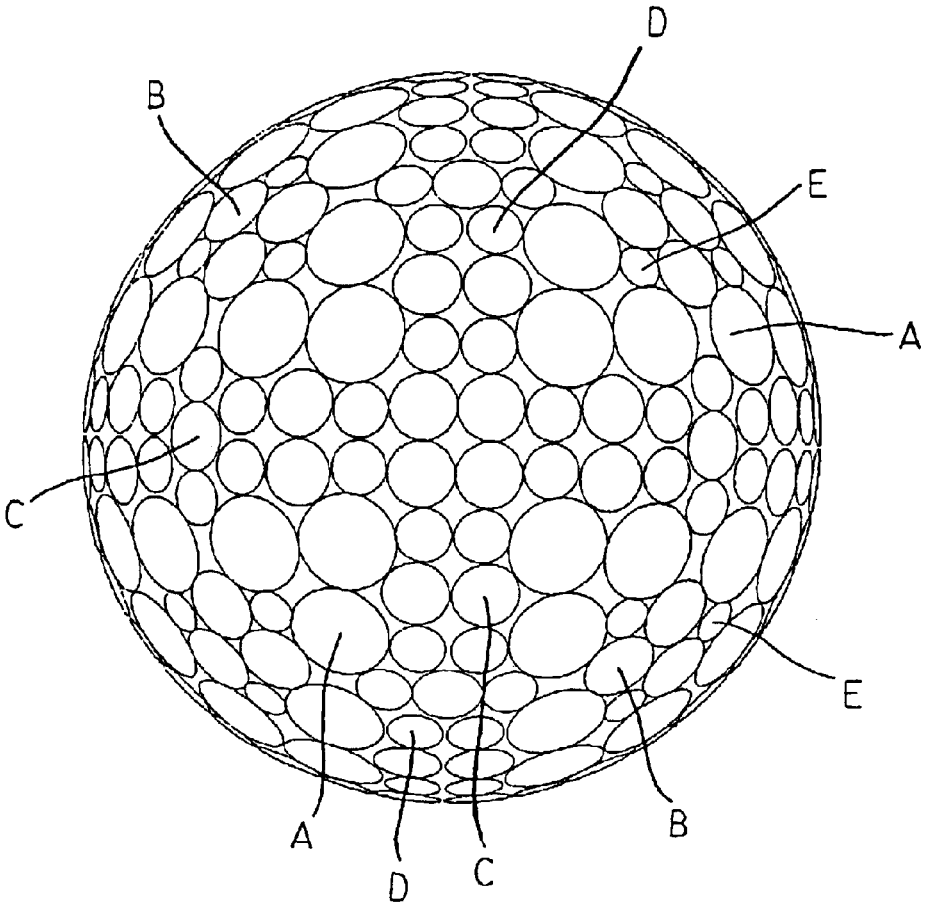
FIG. 7 is a front view showing the golf ball in FIG. 6.

A golf ball according to an example 4 which has a dimple pattern shown in a plan view of FIG. 6 and a front view of FIG. 7 was obtained in the same manner as in the example 1 except that the mold was changed. The golf ball includes 72 A dimples having a circular plane shape, a diameter of 5.9 mm and a curvature r of 48.72 mm, 24 B dimples having a circular plane shape, a diameter of 4.5 mm and a curvature r of 28.36 mm, 88 C dimples having a circular plane shape, a diameter of 3.8 mm and a curvature r of 19.19 mm, 112 D dimples having a circular plane shape, a diameter of 3.6 mm and a curvature r of 16.21 mm, and 24 E dimples having a circular plane shape, a diameter of 2.7 mm and a curvature r of 11.01 mm. In the golf ball, a total contour length X is 4194.7 mm, a total volume V is 500.0 $mm^3$, a mean curvature R is 24.9 mm, and a surface area occupation ratio Y is 0.808.

Comparative Example 1

Figure 8:
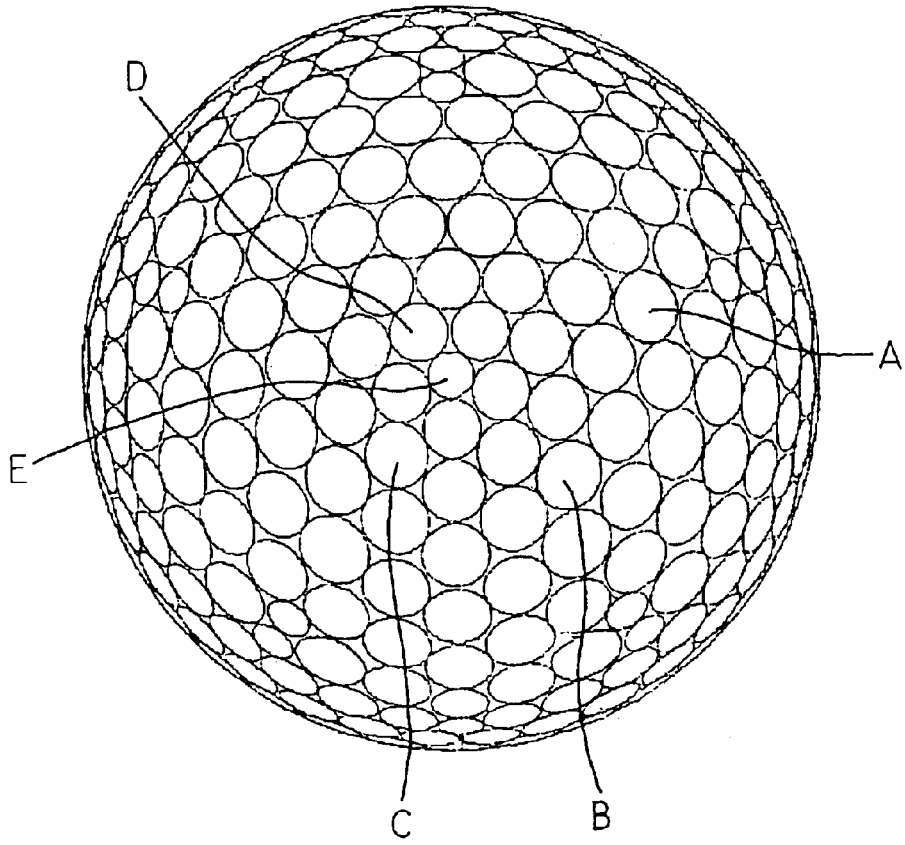
FIG. 8 is a plan view showing a golf ball according to a comparative example 1 of the present invention.
Figure 9:
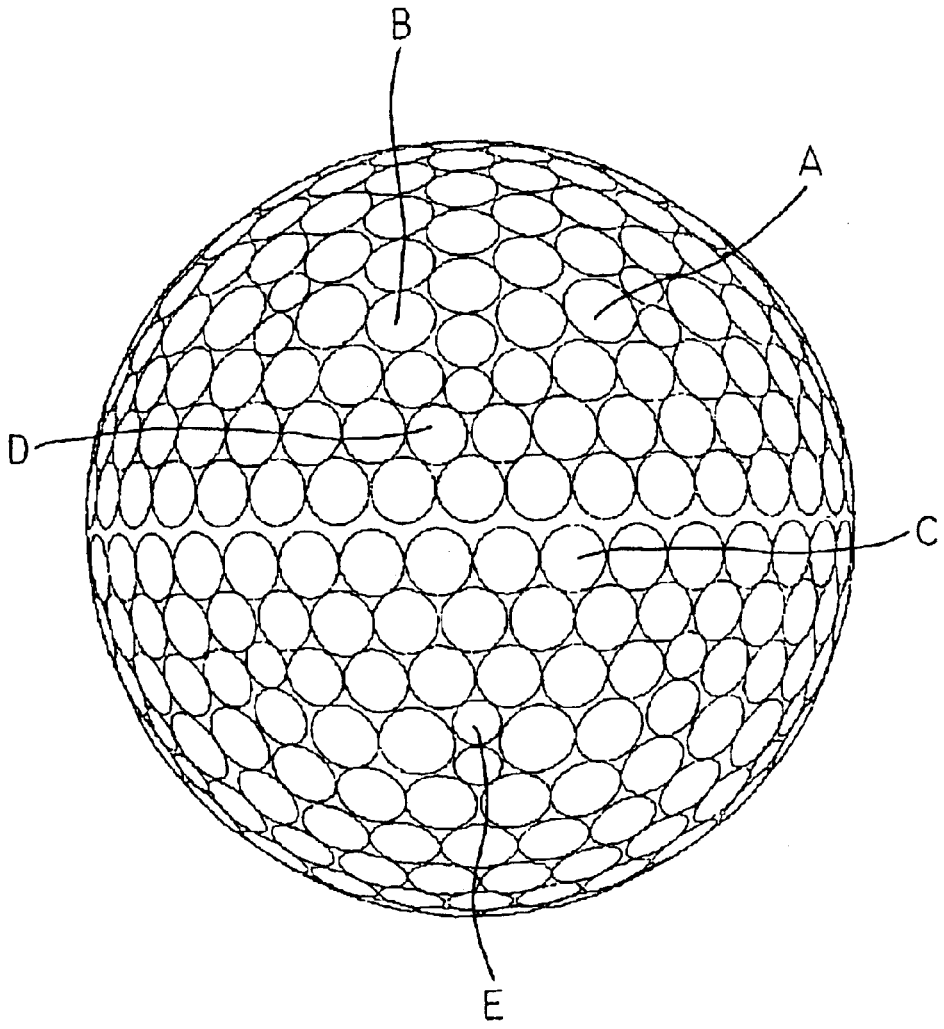
FIG. 9 is a front view showing the golf ball in FIG. 8.

A golf ball according to a comparative example 1 which has a dimple pattern shown in a plan view of FIG. 8 and a front view of FIG. 9 was obtained in the same manner as in the example 1 except that the mold was changed. The golf ball includes 30 A dimples having a circular plane shape, a diameter of 4.3 mm and a curvature r of 18.45 mm, 130 B dimples having a circular plane shape, a diameter of 4.0 mm and a curvature r of 15.97 mm, 180 C dimples having a circular plane shape, a diameter of 3.7 mm and a curvature r of 13.68 mm, 60 D dimples having a circular plane shape, a diameter of 3.4 mm and a curvature r of 11.56 mm, and 32 E dimples having a circular plane shape, a diameter of 2.8 mm and a curvature r of 7.86 mm. In the golf ball, a total contour length X is 5053.6 mm, a total volume V is 499.9 $mm^3$, a mean curvature R is 14.0 mm, and a surface area occupation ratio Y is 0.829.

Comparative Example 2

Figure 10:
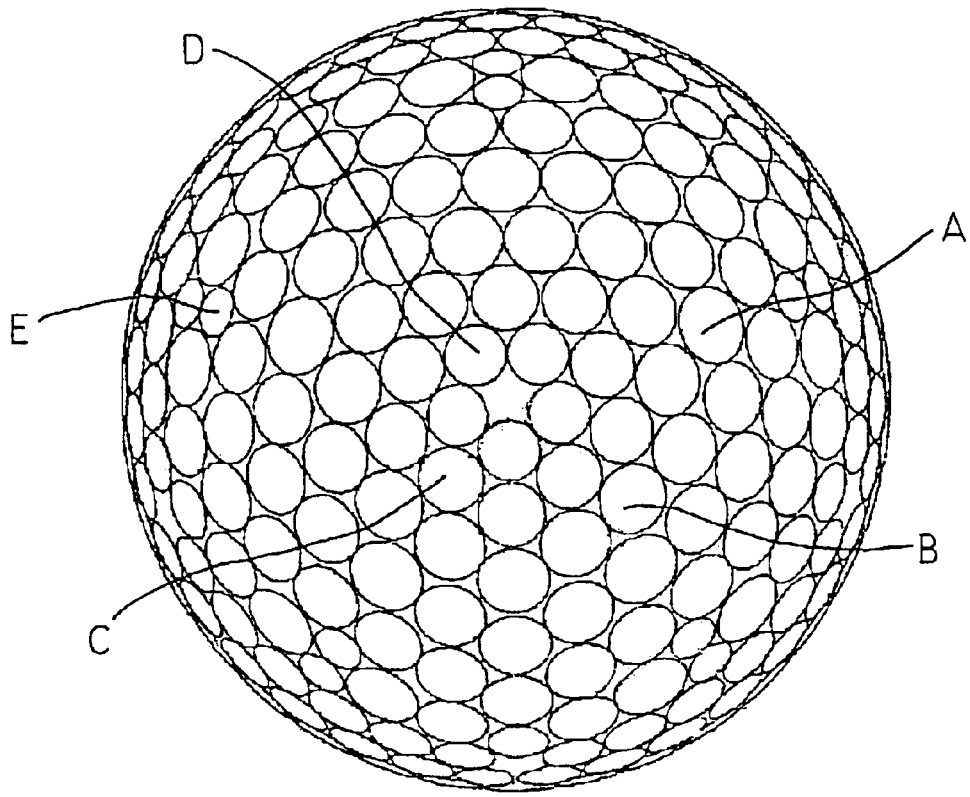
FIG. 10 is a plan view showing a golf ball according to a comparative example 2 of the present invention.
Figure 11:
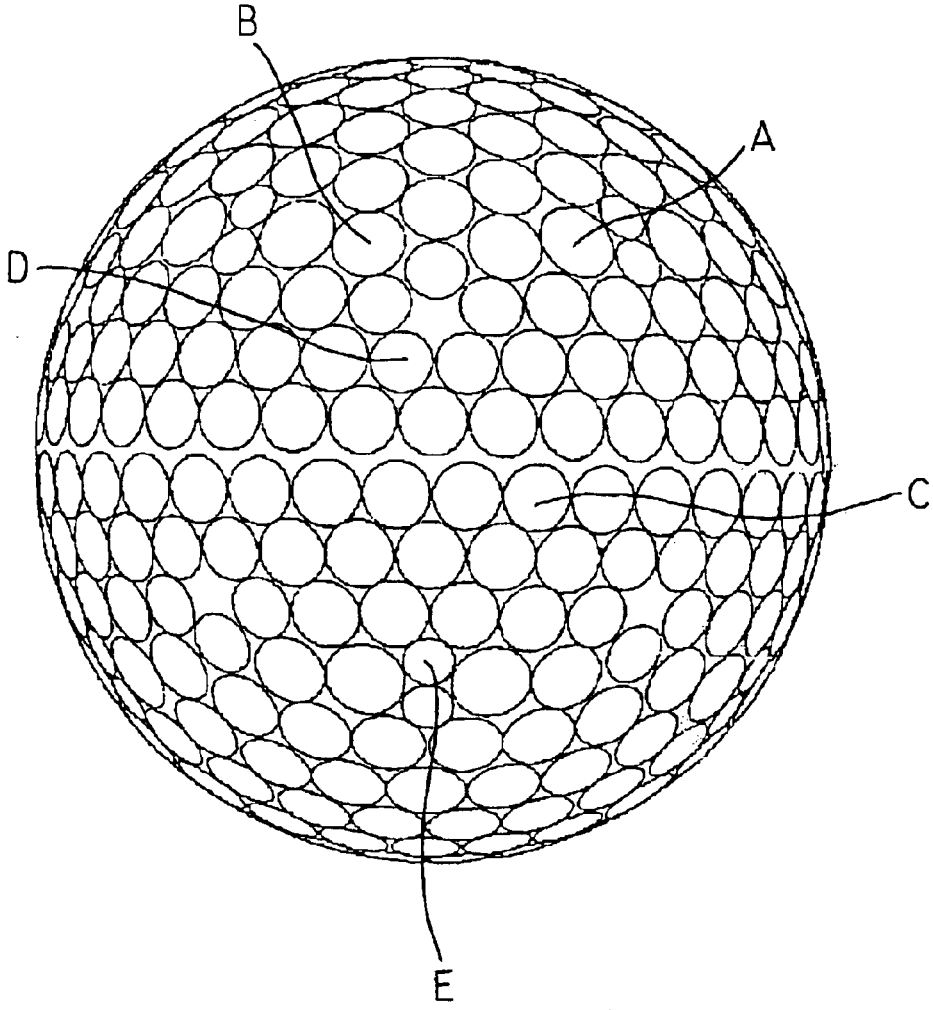
FIG. 11 is a front view showing the golf ball in FIG. 10.

A golf ball according to a comparative example 2 which has a dimple pattern shown in a plan view of FIG. 10 and a front view of FIG. 11 was obtained in the same manner as in the example 1 except that the mold was changed. The golf ball includes 30 A dimples having a circular plane shape, a diameter of 4.3 mm and a curvature r of 18.06 mm, 130 B dimples having a circular plane shape, a diameter of 4.0 mm and a curvature r of 15.64 mm, 180 C dimples having a circular plane shape, a diameter of 3.7 mm and a curvature r of 13.39 mm, 60 D dimples having a circular plane shape, a diameter of 3.4 mm and a curvature r of 11.32 mm, and 20 E dimples having a circular plane shape, a diameter of 2.8 mm and a curvature r of 7.70 mm. In the golf ball, a total contour length X is 4948.0 mm, a total volume V is 499.9 $mm^3$, a mean curvature R is 13.9 mm, and a surface area occupation ratio Y is 0.816.

Comparative Example 3

Figure 12:
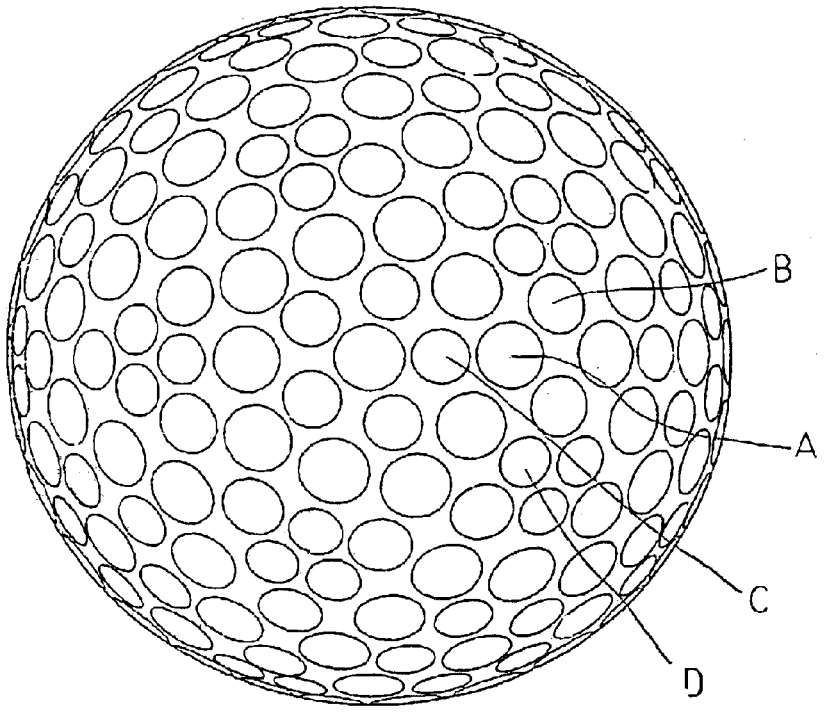
FIG. 12 is a plan view showing a golf ball according to a comparative example 3 of the present invention.
Figure 13:
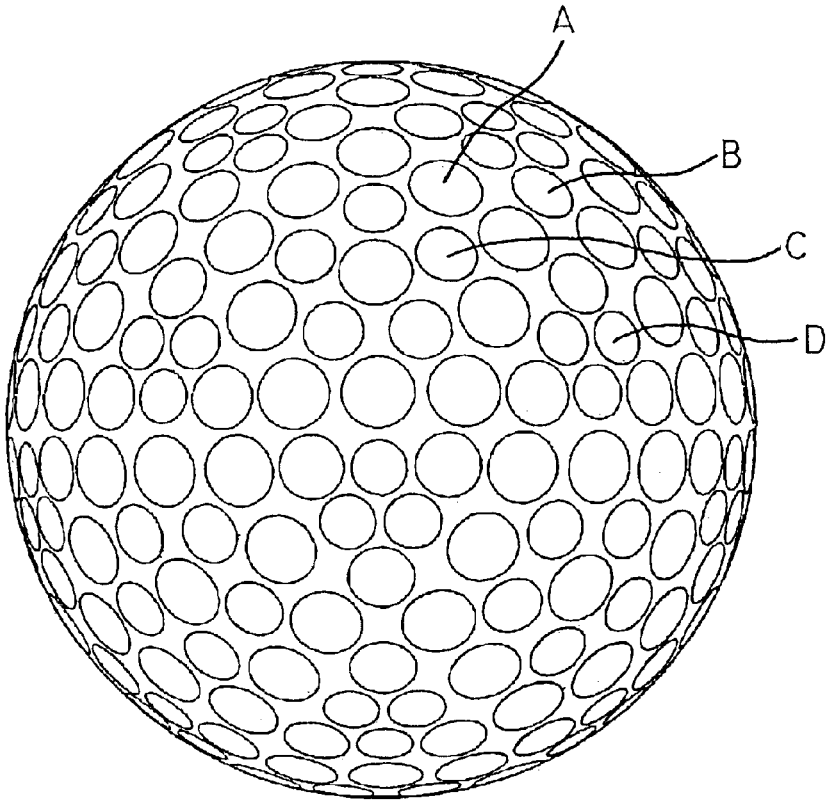
FIG. 13 is a front view showing the golf ball in FIG. 12.

A golf ball according to a comparative example 3 which has a dimple pattern shown in a plan view of FIG. 12 and a front view of FIG. 13 was obtained in the same manner as in the example 1 except that the mold was changed. The golf ball includes 132 A dimples having a circular plane shape, a diameter of 4.4 mm and a curvature r of 15.66 mm, 60 B dimples having a circular plane shape, a diameter of 4.2 mm and a curvature r of 14.28 mm, 60 C dimples having a circular plane shape, a diameter of 3.5 mm and a curvature r of 9.94 mm, and 60 D dimples having a circular plane shape, a diameter of 3.3 mm and a curvature r of 8.84 mm. In the golf ball, a total contour length X is 3898.1 mm, a total volume V is 500.0 $mm^3$, a mean curvature R is 13.0 mm, and a surface area occupation ratio Y is 0.686.

[Flight Distance Test]

20 golf balls according to each of the examples and the comparative examples were prepared and were maintained at 23° C. On the other hand, a driver comprising a metal head (trade name of "XXIOW#1" produced by Sumitomo Rubber Industries, Ltd., loft: 8 degrees, shaft hardness: X) was attached to a swing machine (produced by Golf Lab Co., Ltd.). Machine conditions were set to have a head speed of 50 m/sec, a back spin speed of approximately 2000 rpm obtained immediately after hitting and a launch angle of approximately 10 degrees, and the golf ball was hit and a flight distance (a distance between a launch point and a stationary point) was measured. The following Tables 1 and 2 show the mean value of the results of measurement for the 20 golf balls.

TABLE 1

Dimple Specification and Evaluation Result

| | Type | Diameter d (mm) | Curvature r (mm) | Number | Number ratio (%) | Contour length x (mm) | Total number N | Total contour length X (mm) | Total Volume V ($mm^3$) | Mean curvature R (mm) | Occupation ratio Y | Mean occupation ratio Y | Flight distance (m) |
|---|---|---|---|---|---|---|---|---|---|---|---|---|---|
| Example 1 | A | 4.5 | 23.98 | 130 | 34.9 | 14.1 | 372 | 4701.1 | 500.0 | 19.5 | 0.840 | 0.00226 | 254.5 |
| | B | 4.1 | 19.91 | 150 | 40.3 | 12.9 | | | | | | | |
| | C | 3.5 | 14.53 | 60 | 16.1 | 11.0 | | | | | | | |
| | D | 2.7 | 8.67 | 32 | 8.6 | 8.5 | | | | | | | |
| Example 2 | A | 4.5 | 20.07 | 130 | 34.9 | 14.1 | 372 | 4701.1 | 550.0 | 16.3 | 0.840 | 0.00226 | 252.1 |
| | B | 4.1 | 16.67 | 150 | 40.3 | 12.9 | | | | | | | |
| | C | 3.5 | 12.17 | 60 | 16.1 | 11.0 | | | | | | | |
| | D | 2.7 | 7.27 | 32 | 8.6 | 8.5 | | | | | | | |
| Example 3 | A | 4.4 | 21.64 | 170 | 47.0 | 13.8 | 362 | 4585.5 | 500.1 | 18.4 | 0.818 | 0.00226 | 256.4 |
| | B | 4.0 | 17.90 | 120 | 33.1 | 12.6 | | | | | | | |
| | C | 3.4 | 12.95 | 60 | 16.6 | 10.7 | | | | | | | |
| | D | 2.3 | 5.95 | 12 | 3.3 | 7.2 | | | | | | | |
| Example 4 | A | 5.9 | 48.72 | 72 | 22.5 | 18.5 | 320 | 4194.7 | 500.0 | 24.9 | 0.808 | 0.00252 | 258.3 |
| | B | 4.5 | 28.36 | 24 | 7.5 | 14.1 | | | | | | | |
| | C | 3.8 | 19.19 | 88 | 27.5 | 11.9 | | | | | | | |
| | D | 3.6 | 16.21 | 112 | 35.0 | 11.3 | | | | | | | |
| | E | 2.7 | 11.01 | 24 | 7.5 | 8.5 | | | | | | | |

TABLE 2

Dimple Specification and Evaluation Result

| | Type | Diameter d (mm) | Curvature r (mm) | Number | Number ratio (%) | Contour length x (mm) | Total number N | Total contour length X (mm) | Total Volume V ($mm^3$) | Mean curvature R (mm) | Occupation ratio Y | Mean occupation ratio y | Flight distance (m) |
|---|---|---|---|---|---|---|---|---|---|---|---|---|---|
| Com. | A | 4.3 | 18.45 | 30 | 6.9 | 13.5 | 432 | 5053.6 | 499.9 | 14.0 | 0.829 | 0.00192 | 248.2 |
| Example 1 | B | 4.0 | 15.97 | 130 | 30.1 | 12.6 | | | | | | | |
| | C | 3.7 | 13.68 | 180 | 41.7 | 11.6 | | | | | | | |
| | D | 3.4 | 11.56 | 60 | 13.9 | 10.7 | | | | | | | |
| | E | 2.8 | 7.86 | 32 | 7.4 | 8.8 | | | | | | | |
| Com. | A | 4.3 | 18.06 | 30 | 7.1 | 13.5 | 420 | 4948.0 | 499.9 | 13.9 | 0.816 | 0.00194 | 247.3 |
| Example 2 | B | 4.0 | 15.64 | 130 | 31.0 | 12.6 | | | | | | | |
| | C | 3.7 | 13.39 | 180 | 42.9 | 11.6 | | | | | | | |
| | D | 3.4 | 11.32 | 60 | 14.3 | 10.7 | | | | | | | |
| | E | 2.8 | 7.70 | 20 | 4.8 | 8.8 | | | | | | | |
| Com. | A | 4.4 | 15.66 | 132 | 42.3 | 13.8 | 312 | 3898.1 | 500.0 | 13.0 | 0.686 | 0.00220 | 242.3 |
| Example 3 | B | 4.2 | 14.28 | 60 | 19.2 | 13.2 | | | | | | | |
| | C | 3.5 | 9.94 | 60 | 19.2 | 11.0 | | | | | | | |
| | D | 3.3 | 8.84 | 60 | 19.2 | 10.4 | | | | | | | |

As is apparent from the Tables 1 and 2, the golf balls according to the examples have greater flight distances than those of the golf balls according to the comparative examples. From the results of evaluation, the advantage of the present invention is apparent.

The above description is only illustrative and can be variously changed without departing from the scope of the present invention.

What is claimed is:

1. A golf ball having a large number of dimples on a surface thereof, wherein a surface area occupation ratio Y of the dimples is 0.80 to 0.90 and a mean curvature R to be a mean value of a curvature r in a sectional shape of the dimple is 16 mm or more.

2. The golf ball according to claim 1, wherein a total volume V of the dimples is 300 $mm^3$ to 700 $mm^3$.

3. The golf ball according to claim 1, wherein a mean occupation ratio Y by a total number N of the dimples is 0.0022 or more.

4. The golf ball according to claim 1, wherein a sum X of a contour length x of the dimple and the surface area occupation ratio Y satisfy a relationship indicated by an expression (I):

$$X \leqq 3882 \cdot Y + 1495 \quad \text{(I)}.$$

5. The golf ball according to claim 1, wherein a ratio of the number of dimples having a contour length x of 10.5 mm or more to a total number N of the dimples is 91% or more.

6. The golf ball according claim 1, in which the dimples have a shape that is a portion of a sphere.

* * * * *